US011105126B2

(12) United States Patent
Ogawase et al.

(10) Patent No.: US 11,105,126 B2
(45) Date of Patent: Aug. 31, 2021

(54) HOOD LOCK APPARATUS

(71) Applicant: MITSUI KINZOKU ACT CORPORATION, Yokohama (JP)

(72) Inventors: Noboru Ogawase, Yokohama (JP); Toshihisa Nishijo, Yokohama (JP)

(73) Assignee: MITSUI KINZOKU ACT CORPORATION, Yokohama (JP)

( * ) Notice: Subject to any disclaimer, the term of this patent is extended or adjusted under 35 U.S.C. 154(b) by 682 days.

(21) Appl. No.: 15/896,958

(22) Filed: Feb. 14, 2018

(65) Prior Publication Data

US 2018/0230719 A1 Aug. 16, 2018

(30) Foreign Application Priority Data

Feb. 15, 2017 (JP) ..... JP2017-026313

(51) Int. Cl.
*E05B 83/24* (2014.01)
*E05B 77/36* (2014.01)
(Continued)

(52) U.S. Cl.
CPC ..... *E05B 83/24* (2013.01); *E05B 77/36* (2013.01); *E05B 17/0037* (2013.01); *E05B 85/245* (2013.01); *E05B 2015/0417* (2013.01)

(58) Field of Classification Search
CPC ..... Y10T 292/08; Y10T 292/0801; Y10T 292/081; Y10T 292/0851; Y10T 292/0852; Y10T 292/0853; Y10T 292/0855; Y10T 292/0857; Y10T 292/0859; Y10T 292/0862; Y10T 292/1044;
(Continued)

(56) References Cited

U.S. PATENT DOCUMENTS 2,924,473 A * 2/1960 Krause ..... E05B 83/16 292/216
3,236,551 A * 2/1966 Nash ..... E05B 83/16 292/216
(Continued)

FOREIGN PATENT DOCUMENTS

CN 101135211 A 3/2008
CN 106232920 A 12/2016
(Continued)

OTHER PUBLICATIONS

Extended European Search Report for European Application No. 18155903.0, dated Apr. 17, 2018, 7 pages.
(Continued)

*Primary Examiner* — Alyson M Merlino
(74) *Attorney, Agent, or Firm* — Foley & Lardner LLP

(57) ABSTRACT

A hood lock apparatus includes a base plate having a striker groove into which a striker enters in response to a closing operation of a hood, a latch locking the striker entered into the striker groove, a locking plate locking the latch that locks the striker, a rattle lever supporting the striker locked by the latch with the latch, and a rattle spring biasing the rattle lever holding the striker with the latch towards the striker. The rattle spring is disposed to straddle a first center line passing through a rotational shaft of the rattle lever and extending in a direction at right angles to a direction in which the striker groove extends.

4 Claims, 8 Drawing Sheets

(51) Int. Cl.
*E05B 85/24* (2014.01)
*E05B 15/04* (2006.01)
*E05B 17/00* (2006.01)

(58) Field of Classification Search
CPC ..... Y10T 292/1047; Y10T 292/1048; Y10T 292/1053; Y10T 292/1054; Y10T 292/1055; Y10T 292/1057; Y10T 292/1059; Y10T 292/106; Y10T 292/1076; Y10T 292/1078; Y10T 292/108; Y10T 292/0825; Y10T 292/0828; Y10T 292/0829; Y10T 292/0831; Y10S 292/14; E05B 83/24; E05B 77/36; E05B 77/38; E05B 17/0025; E05B 17/0037; E05B 17/0041; E05B 17/0045; E05B 85/245; E05B 2015/0417; E05B 83/16
See application file for complete search history.

(56) References Cited

U.S. PATENT DOCUMENTS 4,643,470 A * 2/1987 Kazuyuki ..... E05B 83/16 292/216
4,886,307 A * 12/1989 Ruckert ..... E05B 17/0025 292/216
5,048,877 A * 9/1991 Rogers, Jr. ..... E05B 83/24 292/216
5,150,933 A * 9/1992 Myslicki ..... E05B 83/16 292/216
5,348,355 A * 9/1994 Oyha ..... E05B 83/16 292/216
5,738,393 A * 4/1998 Chao ..... E05B 83/24 292/216
6,092,845 A * 7/2000 Koenig ..... E05B 83/16 292/225
6,422,616 B1 * 7/2002 Wortmann ..... E05B 83/24 292/216
2006/0006669 A1 1/2006 Nelsen
2008/0054151 A1 3/2008 Shimura et al.
2010/0032967 A1 * 2/2010 Otsuka ..... B60N 2/01583 292/240
2011/0169279 A1 * 7/2011 Ishikawa ..... B60N 2/01583 292/96
2012/0161456 A1 * 6/2012 Riedmayr ..... E05B 83/24 292/226
2014/0152028 A1 * 6/2014 Leschnik ..... E05B 83/24 292/337
2015/0076835 A1 * 3/2015 Mitchell ..... E05B 77/38 292/194
2016/0362917 A1 * 12/2016 Gumbo ..... E05B 83/24
2017/0096845 A1 4/2017 Bendel

FOREIGN PATENT DOCUMENTS

DE 20316858 1/2004
JP 02-232487 9/1990
JP 08-270288 A 10/1996
JP 2798412 B2 9/1998

OTHER PUBLICATIONS

Japanese Office Action dated Jan. 7, 2020 for corresponding Application No. 2017-026313.
Office Action dated Jul. 16, 2020 for corresponding Chinese Application No. 201810131695.5.

* cited by examiner

HOOD LOCK APPARATUS

This application claims priority from Japanese Patent Application No. 2017-026313 filed on Feb. 15, 2017, the entire subject-matter of which is incorporated herein by reference.

TECHNICAL FIELD

The disclosure relates to a hood lock apparatus for keeping a hood of a vehicle in a closed state by locking a striker provided on the hood.

BACKGROUND

A hood lock apparatus described in Japanese Patent No. 2798412 includes a base in which a slit in which a striker fits is formed, a fork for locking the striker which fits in the slit, a claw lever for locking the fork by meshing with the fork in which the striker is locked and a lift lever for pushing up the striker which is locked by the fork. A tensile coil spring is provided so as to straddle a space defined between the claw lever and the lift lever, and this tensile coil spring biases the claw lever in a direction in which the claw lever meshes with the fork and biases the lift lever in a direction in which the lift lever pushed up the striker.

There may be a case where low-level noise (rattling noise) is generated as a result of a hood vibrating while a vehicle is running or idling, and a gap between the striker and a latch is raised as one of causes for generating the rattling noise. The vibration of the hood causes repeatedly an abutment between the striker and the latch which are spaced apart from each other with the gap defined therebetween, which generates the rattling noise. In the hood lock apparatus described in Japanese Patent No. 2798412, the tensile coil spring biases the lift lever, and the lift lever so biased pushes up the striker, whereby the gap between the striker and the latch is eliminated, and the generation of rattling noise can be suppressed.

However, in order to push up the hood which is a relatively heavy part, a certain great magnitude of force corresponding to such a heavy part is required. In the hood lock apparatus described in Japanese Patent No. 2798412, the tensile coil spring is placed below a rotational shaft of the lift lever and is placed within a limited range of the hood lock apparatus. In this case, the length and extension amount of the tensile coil spring are limited due to the size of the hood lock apparatus. Then, in order to obtain a biasing force which is good enough to push up the hood, the spring constant of the tensile coil spring is increased. However, in the event that the spring constant of the tensile coil spring is increased, there may be caused fears that the operability in closing the hood is deteriorated.

Namely, for the striker to be locked by the fork, the striker is once pushed in deeper towards a bottom side of the slit than a locking position. This causes the claw lever to mesh with the fork, whereby the fork is locked, and the striker is then locked by the fork so locked. In the event that the spring constant of the tensile coil spring is great, an operation force is increased which is required to once push in the striker deeper towards the bottom side of the slit against the pushing effort of the lift lever. This may causes fears that the operability in closing the hood is deteriorated.

SUMMARY

Illustrative aspects of the disclosure provide a hood lock apparatus which is small in size and superior in operability and which can suppress the generation of rattling noise.

According to one illustrative aspect of the disclosure, there may be provided a hood lock apparatus configured to hold a hood of a vehicle in a closed state by locking a striker provided on the hood, the hood lock apparatus comprising: a base plate fixed to a vehicle body structural member of an engine compartment, the engine compartment being opened and closed by the hood, the base plate comprising a striker groove into which the striker enters in response to a closing operation of the hood; a latch rotatably supported on the base plate, the latch being configured to lock the striker entered into the striker groove so as not to exit from the striker groove; a locking plate rotatably supported on the base plate, the locking plate being configured to lock the latch, which locks the striker, so as not to rotate; a rattle lever rotatably supported on the base plate, the rattle lever being configured to hold the striker, which is locked by the latch, with the latch; and a rattle spring provided to extend between the base plate and the rattle lever, the rattle spring being configured to bias the rattle lever holding the striker with the latch towards the striker, wherein the rattle spring is disposed to straddle a first center line, the first center line passing through a rotational shaft of the rattle lever and extending in a direction which is at right angles to a direction in which the striker groove extends.

According thereto, it is possible to provide the hood lock apparatus which is small in size and superior in operability and which can suppress the generation of rattling noise.

DETAILED DESCRIPTION

Figure 1:
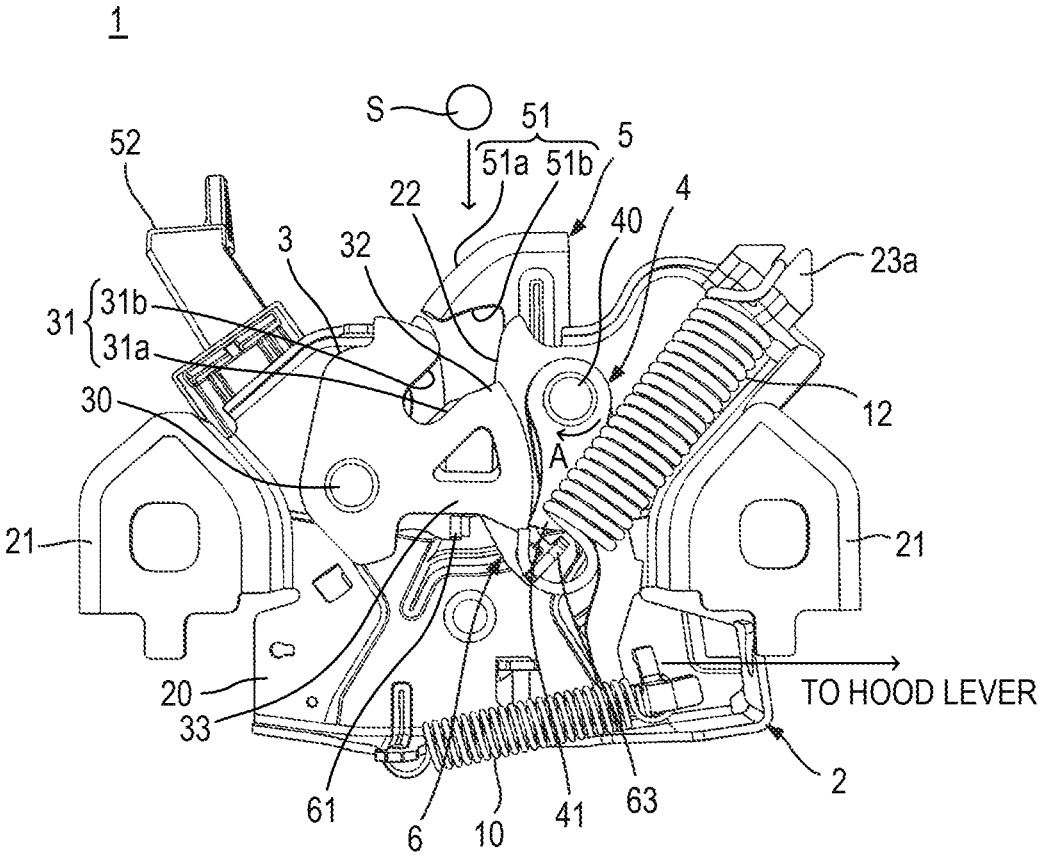
FIG. 1 is a front view of an example of a hood lock apparatus which assists at the description of an embodiment of the disclosure.

A hood lock apparatus 1 is set on a vehicle body structural member of an engine compartment which is opened and closed by a hood of a vehicle and holds the hood in a closed state by locking a striker S which is fixed to a distal end of the hood. The hood lock apparatus 1 includes a base plate 2, a latch 3, a locking plate 4, a secondary latch 5 and a rattle lever 6.

The base plate 2 has a plate-shaped main body portion 20 which supports rotatably thereon the latch 3, the locking plate 4, the secondary latch 5 and the rattle lever 6 and a pair of left and right fixing portions 21 which are fixed to a vehicle body structural member. The pair of fixing portions 21 are provided on one side of the main body portion 20 so as to project from the one side of the main body portion 20.

A space is defined between the main body portion 20 and the vehicle body structural member at a state where the pair of fixing portions 21 are fixed to the vehicle body structural member. A striker groove 22 is provided in the main body portion 20. The striker S enters the striker groove 22 as the hood is closed, and the striker S exits from the striker groove 22 as the hood is opened.

The latch 3 is disposed on a side of the main body portion 20 of the base plate 2 from which the pair of fixing portions 21 are projected. The side of the main body portion 20 faces the vehicle body structural member when the pair of fixing portions 21 are fixed to the vehicle body structural member, and this side of the main body portion 20 may be referred to as a first side. That is, the latch 3 is disposed on the first side of the main body portion 20. The latch 3 is disposed on either of a left-hand and right-hand sides of the striker groove 22 of the base plate 2. The latch 3 is rotatably supported on the main body portion 20 of the base plate 2 by a latch shaft 30 provided on the base plate 2.

The latch 3 has a locking groove 31 which locks the striker S. Then, the latch 3 can rotate between an unlatching position (refer to FIG. 1) where an opening of the locking groove 31 overlaps an opening of the striker groove 22 of the base plate 2 so that the striker S is allowed to enter and exit from the striker groove 22 and the locking groove 31 and a latching position (refer to FIG. 4) where the opening of the locking groove 31 deviates from the striker groove 22 so that the striker S is surrounded four sides by both side walls of the striker groove 22 and both side walls 31*a*, 31*b* of the locking groove 31, whereby the striker S is locked so as not to exit from the striker groove 22 and the locking groove 31.

A first engaging portion 32, which is configured to be brought into engagement with the locking plate 4, is provided at an open end portion of the locking groove 31 of the latch 3. A second engaging portion 33, which is configured to be brought into engagement with the rattle lever 6, is provided on an outer circumferential portion of the latch 3.

As with the latch 3, the locking plate 4 is disposed on the first side of the main body portion 20 of the base plate 2 facing the vehicle body structural member. The locking plate 4 is located on an opposite side of the latch 3 across the striker groove 22 of the base plate 2. The locking plate 4 is rotatably supported by a locking plate shaft 40 which is provided on the base plate 2.

The locking plate 4 has an engaging portion 41 which is configured to be brought into engagement with the first engaging portion 32 of the latch 3. This engaging portion 41 can be rotated between a locking position (refer to FIG. 4) where the engaging portion 41 is brought into engagement with the first engaging portion 32 when the latch 3 is in the latching position so as to prevent the latch 3 from being rotated towards the unlatching position and an unlocking position (refer to FIG. 1) where the engaging portion 41 is disposed apart from the latch 3 so as to release the engagement of the engaging portion 41 with the first engaging portion 32.

Then, the locking plate 4 is biased in a direction indicated by an arrow A towards the locking position by a coiled locking plate spring 10 which is attached to the main body portion 20 of the base plate 2 at one end and to one end portion of the locking plate at the other end thereof.

The locking plate 4 is connected to a hood lever which is provided inside a passenger compartment of the vehicle via a wire, not shown, and is rotated in an opposite direction to the direction indicated by the arrow A towards the unlocking position in response to an operation of the hood lever.

Figure 2:
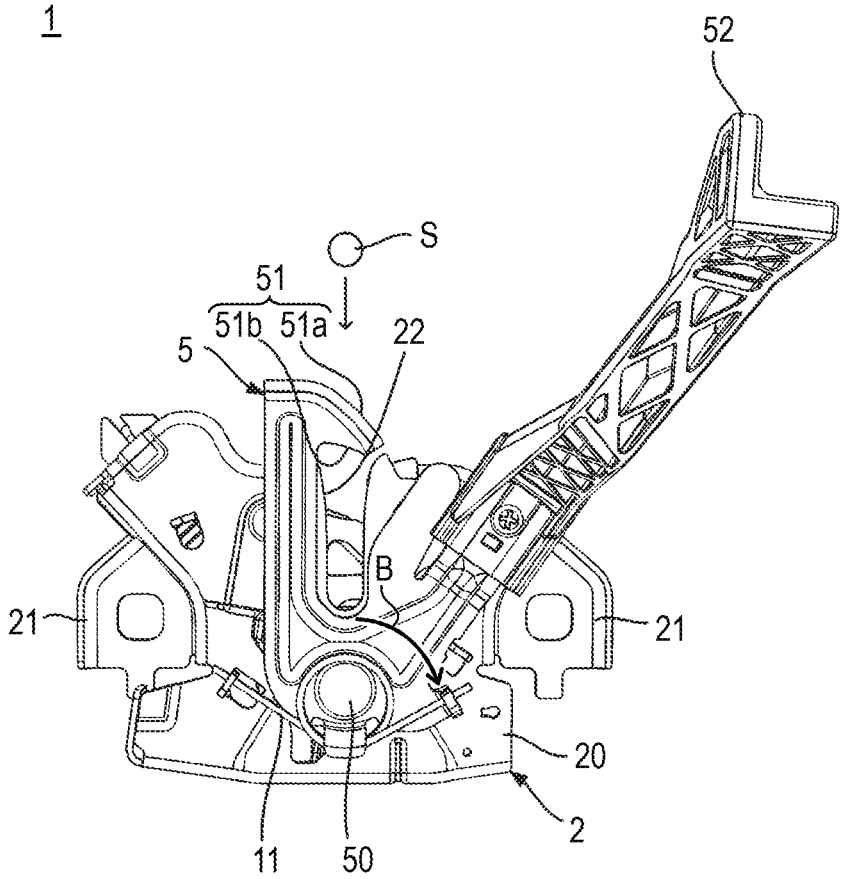
FIG. 2 is a rear view of the hood lock apparatus shown in FIG. 1.

As shown in FIG. 2, the secondary latch 5 is disposed on a second side of the main body portion 20 of the base plate 2. The second side of the main body portion 20 is an opposite side of the first side of the main body portion 20 of the base plate 2 facing the vehicle body structural member. The secondary latch 5 is rotatably supported by a secondary latch shaft 50 provided on the main body portion 20.

The secondary latch 5 has a locking portion 51 for locking the striker S, and the locking portion 51 is disposed outside the striker groove 22 of the main body portion 20 and on a traveling path of the striker S and can be rotated between a secondary latching position (refer to FIGS. 1 and 4) where the striker S which exits from the striker groove 22 is locked and a secondary unlatching position where the locking portion 51 is disposed so as to be deflected from the traveling path of the striker S.

Then, the secondary latch 5 is biased in a direction indicated by an arrow B towards the secondary latching position by a coiled secondary latch spring 11 which is attached to the base plate 2 at one end and to the secondary latch 5 at the other end thereof.

A safety lever 52 is connected to the secondary latch 5, and the secondary latch 5 is rotated in an opposite direction to the direction indicated by the arrow B towards the secondary unlatching position in response to an operation of the safety lever 52.

Figure 3:
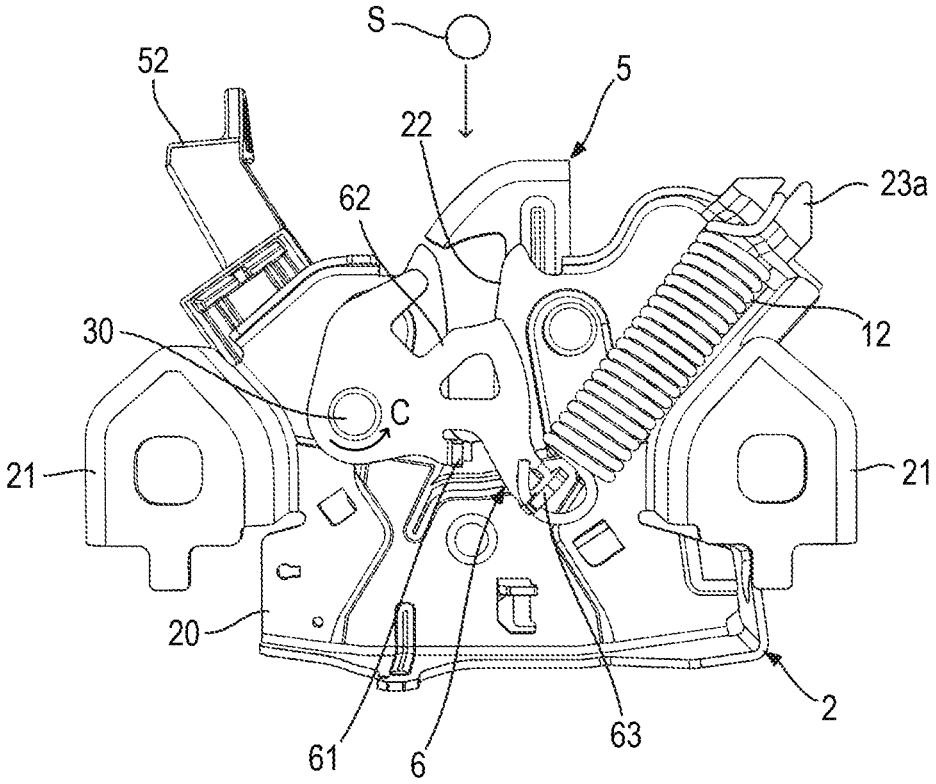
FIG. 3 is a front view of the hood lock apparatus shown in FIG. 1 with a latch and a locking plate omitted from illustration.

As shown in FIG. 3, as with the latch 3 and the locking plate 4, the rattle lever 6 is disposed on the first side of the main body portion 20 of the base plate 2 facing the vehicle body structural member. The rattle lever 6 is disposed between the main body portion 20 and the latch 3. The rattle lever 6 is rotatably supported by the latch shaft 30.

Then, the rattle lever 6 is biased in a direction indicated by an arrow C by a coiled rattle spring 12 which is attached to the main body portion 20 of the base plate 2 at one end and to the rattle lever 6 at the other end thereof.

The rattle lever 6 has an engaging portion 61 which is configured to be brought into engagement with the second engaging portion 33 (refer to FIG. 1) of the latch 3. When the latch 3 stays in the unlatching position, the engaging portion 61 is brought into engagement with the second engaging portion 33, and the rattle lever 6 is rotated together with the latch 3 in an opposite direction to the direction indicated by the arrow C as the latch 3 is rotated from the unlatching position towards the latching position. A biasing force of the rattle spring 12 is transmitted to the latch 3 via the engagement of the second engaging portion 33 with the engaging portion 61, whereby the latch 3 is biased towards the unlatching position.

The rattle lever 6 has a holding portion 62 which holds the striker S which is locked by the latch 3 in an interior of the locking groove 31. When the latch 3 stays in the latching position, the holding portion 62 is disposed so as to project into the locking groove 31 from the side wall 31*a*, which is positioned on a bottom side of the striker groove 22, so as to hold the striker S together with the side wall 31*b*, which is positioned on an opening side of the striker groove 22, such that the striker S is held between the holding portion 62 and the side wall 31*b*. Incidentally, of the side walls 31*a*, 31*b* of the locking groove 31 of the latch 3, the side wall 31*a* on a first side of the striker groove 22 may be referred to as a first side wall 31*a*, and the side wall 31*b* on a second side of the striker groove 22 may be referred to as a second side wall 31*b*. The first side of the striker groove 22 may be the bottom side, and the second side of the striker groove 22 may be the opening side.

Figure 4:
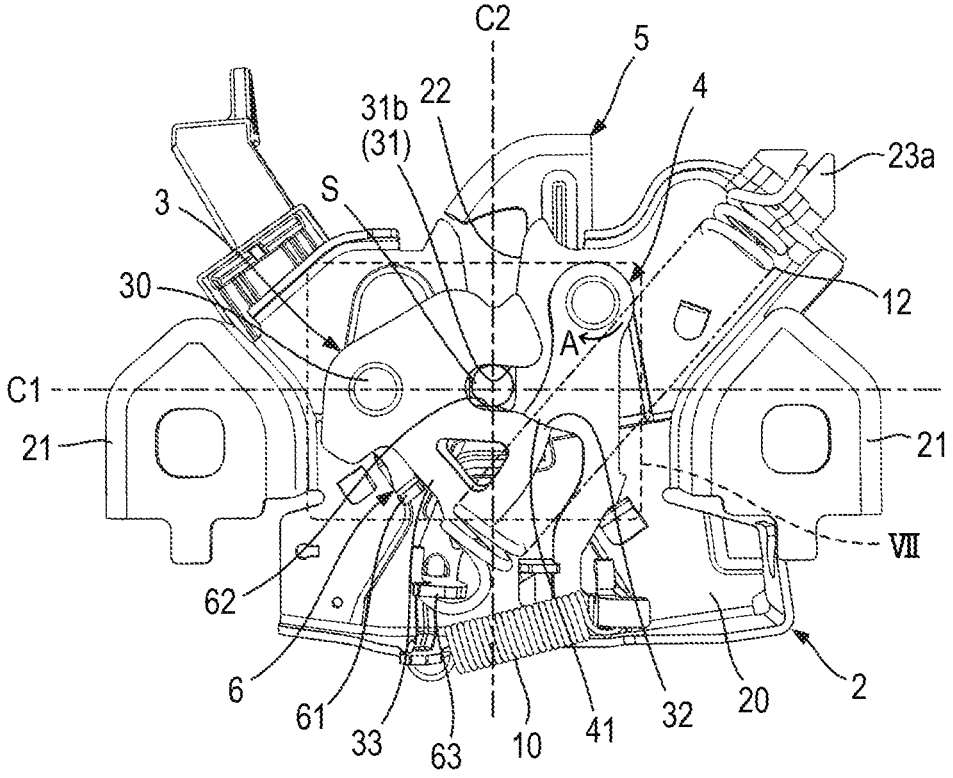
FIG. 4 is a front view of a state of the hood lock apparatus shown in FIG. 1 in which the hood lock apparatus holds a hood in a fully closed state.
Figure 5:
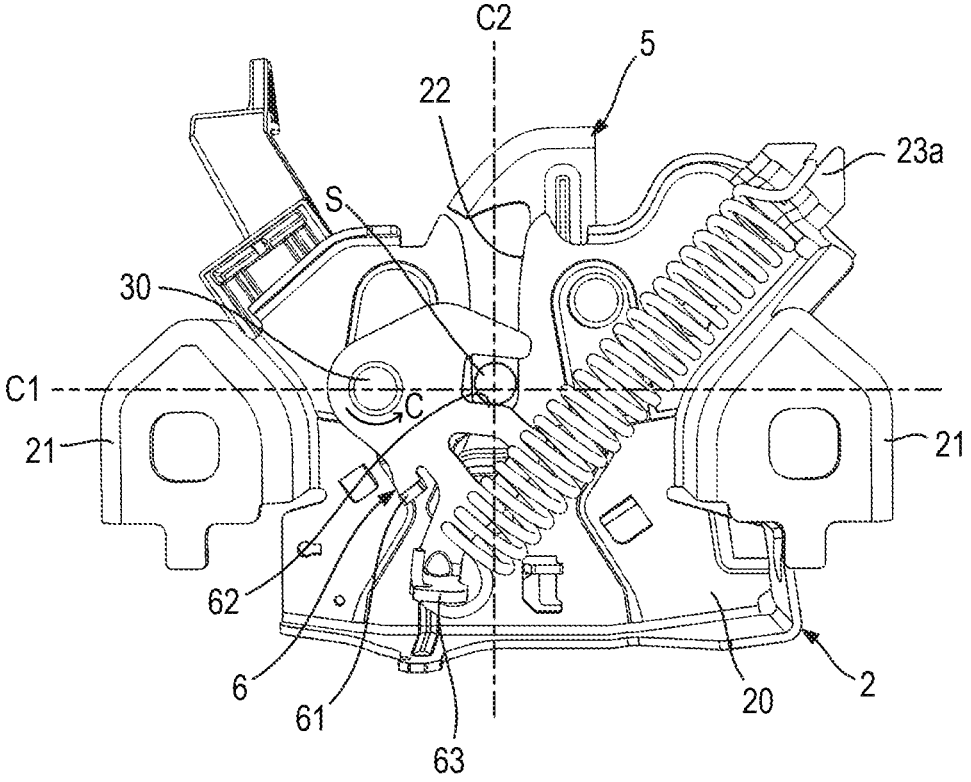
FIG. 5 is a front view of the hood lock apparatus shown in FIG. 4 with the latch and the locking plate omitted from illustration.

As shown in FIGS. 4 and 5, the rattle lever 6 is rotated together with the latch 3 as the latch 3 rotates towards the latching position, and the rattle spring 12 is stretched as the rattle lever 6 is so rotated. Then, with the rattle spring 12 stretched, the rattle spring 12 is disposed to straddle a first center line C1. The first center line C1 passes through the latch shaft 30 acting as a rotational shaft of the rattle lever 6 and extends in a direction at right angles to a direction in which the striker groove 22 of the base plate 2 extends. The first center line C1 may be referred to as a vertical center line C1.

Specifically, an attaching portion 23*a* of the base plate 2 to which one end of the rattle spring 12 is attached is provided at a side of an opening of the striker groove 22 and is disposed on an upper side of the first center line C1. An attaching portion 63 of the rattle lever 6 to which the other end of the rattle spring 12 is attached is disposed on a lower side of the first center line C1 with the latch 3 staying in the latching position and the rattle lever 6 rotated in an opposite direction to the direction indicated by the arrow C.

As a result of the rattle spring 12 being disposed to straddle the first center line C1, the stretching amount of the rattle spring 12 is expanded within the limited space in the hood lock apparatus 1 compared with a case where the rattle spring 12 is stretched and contracted on either side of the first center line C1.

Further, in this example, the rattle spring 12 is disposed to straddle a second center line C2 extending along the striker groove 22 of the base plate 2. The second center line C2 may be referred to as a horizontal center line C2. In the illustrated example, the attaching portion 23*a* of the base plate 2 provided on a periphery of the opening of the striker groove 22 is disposed on a right-hand side of the second center line C2, and the attaching portion 63 of the rattle lever 6 is disposed on a left-hand side of the second center line C2 (see, for example, FIGS. 4 and 5). By adopting this configuration, the stretching amount of the rattle spring 12 is expanded further within the limited space in the hood lock apparatus 1 compared with a case where the rattle spring 12 is stretched and contracted on either side of the second center line C2.

Figure 6:
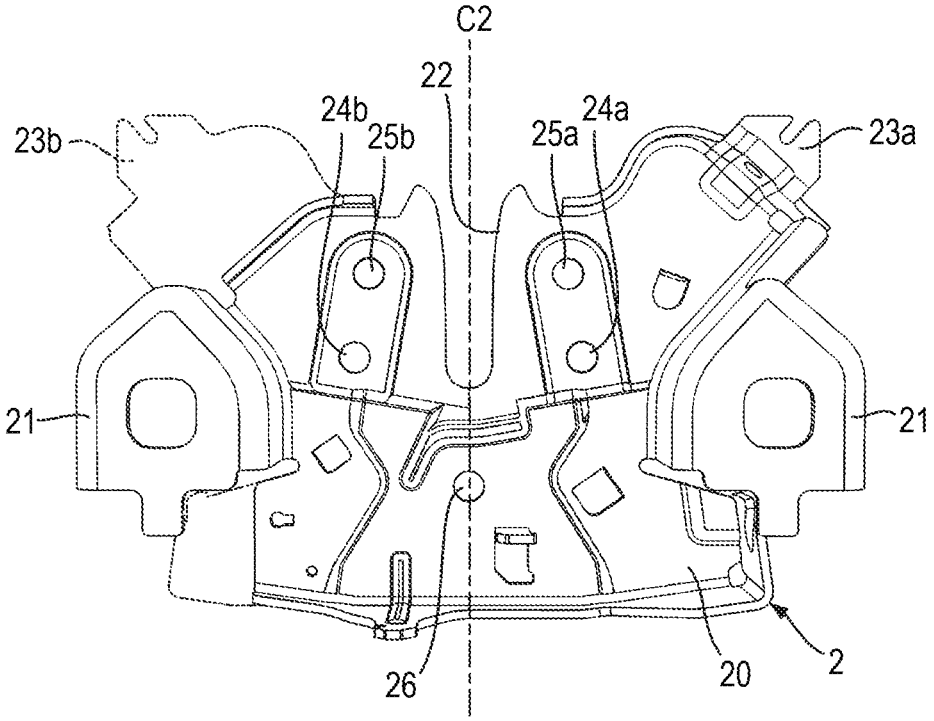
FIG. 6 is a front view of a base plate of the hood lock apparatus shown in FIG. 1.

As shown in FIG. 6, before the rattle spring 12 and the like are assembled on to the base plate 2, the base plate 2 has a first attaching portion 23*a* and a second attaching portion 23*b* to which one end of the rattle spring 12 can be attached, and the first attaching portion 23*a* and the second attaching portion 23*b* are provided laterally symmetrical across the second center line C2. One end of the rattle spring 12 is attached to either of the first attaching portion 23*a* and the second attaching portion 23*b* (in the illustrated example, to the attaching portion 23*a*), and the other attaching portion (in the illustrated example, the attaching portion 23*b*) is removed, for example.

Similarly, the base plate 2 has a first attaching portion 24*a* and a second attaching portion 24*b* to which the latch shaft 30, which acts as the rotational shaft about which the latch 3 and the rattle lever 6 rotate, can be attached. The base plate 2 also has a first attaching portion 25*a* and a second attaching portion 25*b* to which the locking plate shaft 40, which acts as the rotational shaft about which the locking plate 4 rotates, can be attached. The first attaching portion 24*a* and the second attaching portion 24*b* are provided laterally symmetrical across the second center line C2, and the first attaching portion 25*a* and the second attaching portion 25*b* are also provided laterally symmetrical across the second center line C2.

In this way, the first attaching portion and the second attaching portion which are laterally symmetrical across the second center line C2 are provided on the base plate 2 for each of the latch 3, the locking plate 4, the rattle lever 6 and the rattle spring 12, whereby the latch 3 and the others can be attached to the base plate 2 which is common for a left-hand drive vehicle and a right-hand drive vehicle. This realizes a reduction in production cost of the hood lock apparatus 1. It should be noted that an attaching portion 26 to which the secondary latch shaft 50, which acts as the rotational shaft of the secondary latch 5, is attached is provided on the second center line C2 and that only one attaching portion 26 is provided.

Hereinafter, an operation of the hood lock apparatus will be described.

Referring to FIGS. 1 to 3, firstly, in closing the hood, the striker S which moves as the hood is closed is brought into abutment with an outer edge portion 51*a* of the locking portion 51 of the secondary latch 5 which is disposed on the traveling path of the striker S. The outer edge portion 51*a* is inclined relative to the traveling path of the striker S, and as a result of the striker S being brought into abutment with the locking portion 51, the secondary latch 5 is rotated in an opposite direction to the direction indicted by the arrow B towards the secondary unlatching position. This deflects the locking portion 51 so as to be disposed out of the traveling path of the striker S, whereby the striker groove 22 of the base plate 2 is opened.

The striker S enters the striker groove 22 which is now opened and enters further the locking groove 31 of the latch 3 which stays in the unlatching position. Then, the striker S which has entered the locking groove 31 presses against the side wall 31*a* of the locking groove 31 which lies ahead of the striker S which is moving deeper into the locking groove 31. Thus, the striker S moves towards a bottom of the striker groove 22 while rotating the latch 3 towards the latching position. Then, the rattle lever 6 whose engaging portion 61 is in engagement with the second engaging portion 33 of the latch 3 is also rotated in the opposite direction to the direction indicated by the arrow C together with the latch 3 as the latch 3 is rotated towards the latching position as a result of the latch 3 being pressed against by the striker S.

Referring to FIGS. 4 and 5, when the striker S arrives at a bottom portion of the striker groove 22, the latch 3 is disposed in the latching position, and the locking plate 4 is disposed in the locking position. This brings the first engaging portion 32 of the latch 3 into engagement with the engaging portion 41 of the locking plate 4, and the latch 3 is locked by the locking plate 4. The striker S is locked by the latch 3, and the hood is held in a fully closed state by the hood lock apparatus 1.

Here, in order to bring the first engaging portion 32 of the latch 3 into engagement with the engaging portion 41 of the locking plate 4, the striker S needs to be pushed in once deeper towards the bottom of the striker groove 22 than the locking position. As a result of the striker S being pushed in once deeper towards the bottom of the striker groove 22 than the locking position, the latch 3 is rotated to pass the latching position, whereby the engaging portion 41 of the locking plate 4 rides over the first engaging portion 32 of the latch 3 to be brought into engagement with the first engaging portion 32. As this occurs, although the rattle lever 6 is rotated in the opposite direction to the direction indicated by the arrow C together with the latch 3, the biasing force of the rattle spring 12 which biases the rattle lever 6 in the direction indicated by the arrow C constitutes a resistance against the effort with which the striker S is pushed in once deeper towards the bottom of the striker groove 22 than the locking position.

In the hood lock apparatus 1, as described above, the rattle spring 12 is disposed to straddle the first center line C1, and the stretching amount of the rattle spring 12 is expanded within the limited space of the hood lock apparatus 1. Namely, the biasing force of the rattle spring 12 is ensured by the stretching amount of the rattle spring 12, and the spring constant of the rattle spring 12 is suppressed to a relatively low level. Because of this, the resistance caused by the biasing force of the rattle spring 12 when the striker S is pushed in once deeper towards the bottom of the striker groove 22 than the locking position is reduced, whereby the operability in closing the hood is improved.

Next, in such a state that the hood is held in the fully closed state, that is, in such a state that the latch 3 is locked by the locking plate 4 and the striker S is locked by the latch 3, the holding portion 62 of the rattle lever 6, which is biased in the direction indicated by the arrow C by the rattle spring 12, is disposed so as to project into the locking groove 31 of the latch 3 to thereby hold the striker S with the side wall 31*b* of the locking groove 31 of the latch 3 at the open side of the striker groove 22, such that the striker S is held between the side wall 31*b* at the opening side of the striker groove 22 and the holding portion 62 of the rattle lever 6. This eliminates the gap between the striker S and the latch 3, whereby the generation of rattling noise is suppressed which is attributed to the repeated abutment of the striker S with the latch 3 caused by vibrations of the vehicle.

Figure 7:
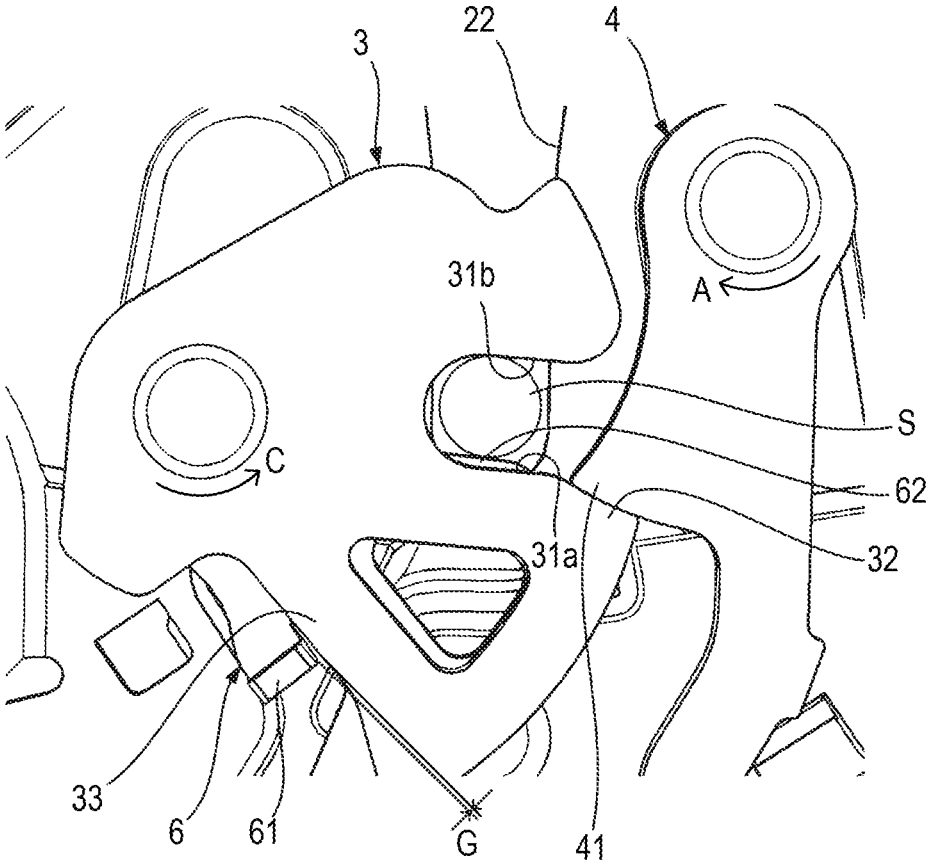
FIG. 7 is an enlarged view of a portion which is surrounded by a broken line frame VII shown in FIG. 4.

Here, as shown in FIG. 7, it is preferable that a gap G is provided between the second engaging portion 33 of the latch 3 and the engaging portion 61 of the rattle lever 6 in such a state that the latch 3 and the rattle lever 6 hold the striker S between the latch 3 and the rattle lever 6. With higher dimensional accuracy of the latch 3 and the rattle lever 6, it is possible to hold the striker S by the latch 3 and the rattle lever 6 between them in such a state that the second engaging portion 33 is in engagement with the engaging portion 61. However, with the second engaging portion 33 and the engaging portion 61 disposed apart from each other, the striker S can be held by the latch 3 and the rattle lever 6 between the latch 3 and the rattle lever 6 without requiring excessively sever dimensional accuracy on the latch 3 and the rattle lever 6, thereby making it possible to realize a reduction in production cost of the hood lock apparatus 1.

Next, in opening the hood, firstly, the hood lever in the passenger compartment of the vehicle is operated, whereby the locking plate 4 is rotated in the opposite direction to the direction indicated by the arrow A as the hood lever is operated, and is then disposed in the unlocking position. The engagement of the first engaging portion 32 of the latch 3 with the engaging portion 41 of the locking plate 4 is released as a result of the locking plate 4 being disposed in the unlocking position, whereby the locking of the latch 3 by the locking plate 4 is released.

When the locking of the latch 3 by the locking plate 4 is released, the latch 3 can be rotated towards the unlatching position, and the rattle lever 6 which is biased by the rattle spring 12 is rotated in the direction indicated by the arrow C. The second engaging portion 33 of the latch 3 is brought into engagement with the engaging portion 61 of the rattle lever 6 as the rattle lever 6 rotates, and the biasing force of the rattle spring 12 is transmitted to the latch 3 via the engagement of the second engaging portion 33 with the engaging portion 61, whereby the latch 3 is rotated towards the unlocking position. Then, the striker S is pushed up towards the open side of the striker groove 22 of the base plate 2 by the latch 3.

Figure 8:
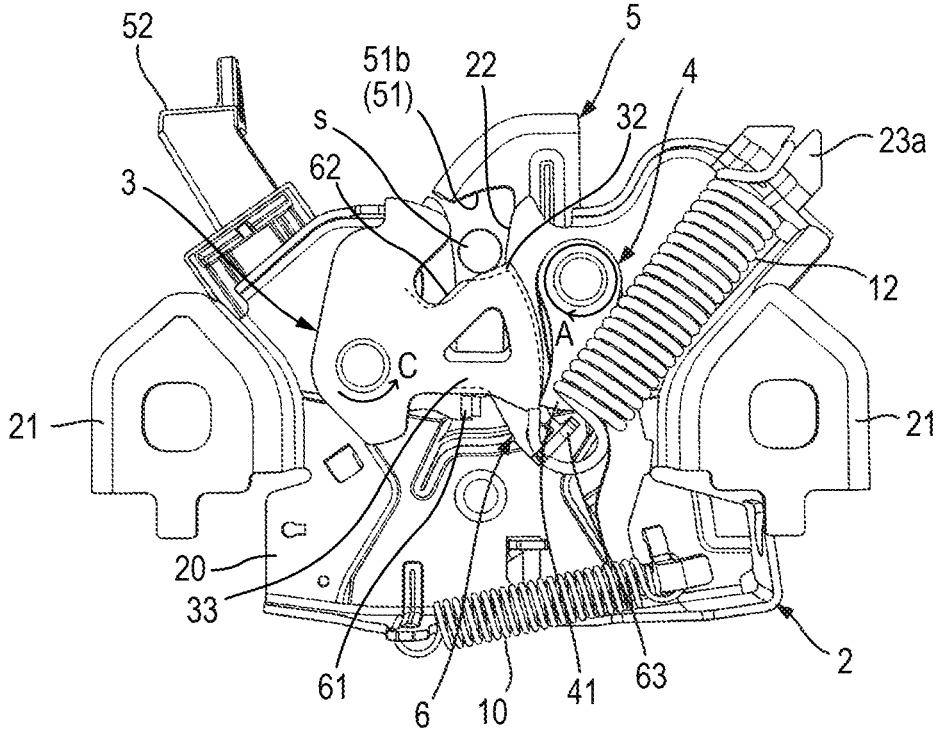
FIG. 8 is a front view of the hood lock apparatus shown in FIG. 1, showing a state where a hood is popped up.

Here, as shown in FIG. 8, it is preferable that the rattle lever 6 is spaced apart from the striker S in such a state that the second engaging portion 33 of the latch 3 is in engagement with the engaging portion 61 of the rattle lever 6. In a case where the striker S is kept in contact with the rattle lever 6, friction is generated by a sliding contact between the striker S and the rattle lever 6. However, no friction is generated between the rattle lever 6 and the striker S as a result of the rattle lever 6 being spaced apart from the striker S, whereby the latch 3 and the rattle lever 6 are allowed to rotate smoothly, which enhances the ensured operation of the hood lock apparatus 1.

The striker S which is pushed up by the latch 3 is brought into abutment with an inner edge portion 51*b* of the locking portion 51 of the secondary latch 5 which is disposed on the traveling path of the striker S, whereby the striker S is stopped in the vicinity of the open end of the striker groove 22. This stops the opening operation of the hood temporarily, and the hood is popped up to a predetermined opening angle or open position.

In opening the hood fully, the safety lever 52 is operated manually, whereby the secondary latch 5 is rotated in an opposite direction to the direction indicated by the arrow B (refer to FIG. 2) as the safety lever 52 is operated and is then disposed in the secondary unlocking position. When the secondary latch 5 is disposed in the secondary unlocking position, the locking portion 51 is deflected to be disposed out of the traveling path of the striker S, whereby the striker groove 22 is opened. This allows the striker S to exit from the striker groove 22, whereby the hood is opened fully.

Thus, as has been described heretofore, according to the hood lock apparatus 1, the rattle spring 12, which biases the rattle lever 6 holding the striker S with the latch 3 between the latch 3 and the rattle lever 6, is disposed to straddle the first center line C1. The first center line C1 passes through the latch shaft 30 acting as a rotational shaft of the rattle lever 6 and extends in the direction at the right angles to the direction in which the striker groove 22 of the base plate 2 extends. The stretching amount of the rattle spring 12 is expanded even within the limited space of the hood lock apparatus 1. The biasing force of the rattle spring 12 is ensured by the stretching amount of the rattle spring 12, so that it is possible to provide the hood lock apparatus 1, which is small in size and superior in operability, and which can suppress the generation of rattle noise.

What is claimed is:

1. A hood lock apparatus configured to hold a hood of a vehicle in a closed state by locking a striker provided on the hood, the hood lock apparatus comprising:

a base plate fixed to a vehicle body structural member of an engine compartment of the vehicle, the engine compartment being opened and closed by the hood, the base plate comprising a striker groove into which the striker enters in response to a closing operation of the hood;

a latch rotatably supported on the base plate, the latch being configured to lock the striker entered into the striker groove such that the striker does not exit from the striker groove;

a locking plate rotatably supported on the base plate, the locking plate being configured to lock the latch when the latch locks the striker such that the latch does not rotate;

a rattle lever rotatably supported on the base plate, the rattle lever being configured to hold the striker when the striker is locked by the latch; and a rattle spring provided to extend between the base plate and the rattle lever, the rattle spring being configured to bias the rattle lever towards the striker so as to hold the striker when the striker is locked by the latch, wherein the rattle spring is disposed to straddle a first center line, the first center line passing through a rotational shaft of the rattle lever and extending in a direction which is at a right angle to a direction in which the striker groove extends, wherein the rattle spring is disposed to straddle a second center line, and the second center line extends along the striker groove, wherein the latch comprises an engaging portion, wherein the rattle lever comprises an engaging portion, wherein the engaging portion of the latch and the engaging portion of the rattle lever are brought into engagement with each other so as to transmit a biasing force of the rattle spring from the rattle lever to the latch, and wherein, in a state where the rattle lever holds the striker with the latch being locked by the locking plate, the engaging portion of the latch and the engaging portion of the rattle lever are spaced apart from each other.

2. The hood lock apparatus according to claim 1, wherein in a state where the locking of the latch by the locking plate is released, the engaging portion of the latch and the engaging portion of the rattle lever are brought into engagement with each other, and the rattle lever is spaced apart from the striker.

3. The hood lock apparatus according to claim 1, wherein the base plate comprises first attaching portions and second attaching portions for each of the latch, the locking plate, the rattle lever and the rattle spring, and wherein the first attaching portions and the second attaching portions are provided laterally symmetrical with respect to the second center line.

4. The hood lock apparatus according to claim 1, wherein the rattle spring is stretchable in a direction including a component parallel to the first center line.

* * * * *